US005452564A

United States Patent [19]

Staats

[11] Patent Number: 5,452,564

[45] Date of Patent: Sep. 26, 1995

[54] METHOD OF ASSEMBLY FOR A WRAPPER-STABILIZED PACKAGING TRAY FOLDED FROM A BLANK OF PAPER-LIKE MATERIAL AND PACKAGE TRAY

[76] Inventor: Antonius P. Staats, Eibenoord 8, Leiden, Netherlands, 2317 XL

[21] Appl. No.: 119,728

[22] Filed: Sep. 10, 1993

Related U.S. Application Data

[63] Continuation of Ser. No. 867,128, Apr. 10, 1992, abandoned.

[30] Foreign Application Priority Data

Apr. 12, 1991 [NL] Netherlands ..... 9100644

[51] Int. Cl.[6] ..... B65B 43/10

[52] U.S. Cl. ..... 53/449; 53/450; 53/456

[58] Field of Search ..... 53/173, 449, 450, 53/456, 458, 550

[56] References Cited

U.S. PATENT DOCUMENTS

| | | | |
|---|---|---|---|
| 2,709,399 | 5/1955 | Smith | 53/173 |
| 2,836,341 | 5/1958 | Nydegger . | |
| 3,416,288 | 12/1968 | Coons | 53/456 X |
| 3,416,653 | 12/1968 | Farquhar | 53/449 X |
| 3,433,401 | 3/1969 | Swift . | |
| 3,461,642 | 8/1969 | Langen et al. | 53/456 |
| 3,627,116 | 12/1971 | Cooper . | |
| 3,696,580 | 10/1972 | Saltzer | 53/449 X |
| 3,927,505 | 12/1975 | Bemiss | 53/456 |
| 4,003,514 | 1/1977 | Graser . | |
| 4,164,315 | 8/1979 | Pennanen . | |
| 4,196,563 | 4/1980 | Gabrielson et al. | 53/456 |
| 4,483,125 | 11/1984 | Suga | 53/550 X |
| 4,632,302 | 12/1986 | Manizza . | |
| 4,702,409 | 10/1987 | Osborne . | |
| 4,871,111 | 10/1989 | Mode . | |
| 4,887,766 | 12/1989 | Schoeneweis . | |
| 4,967,692 | 11/1990 | Mills . | |
| 4,970,846 | 11/1990 | Leino | 53/550 |

FOREIGN PATENT DOCUMENTS

| | | |
|---|---|---|
| 0142904 | 5/1985 | European Pat. Off. . |
| 0249260 | 12/1987 | European Pat. Off. . |

*Primary Examiner*—John Sipos
*Assistant Examiner*—Daniel Moon
*Attorney, Agent, or Firm*—Thomas R. Vigil; James P. Hanrath

[57] ABSTRACT

A packaging tray to be folded from a blank of paper-like material, comprising end wall panels and side wall panels; the side wall panels are twice as high as the end wall panels so that the side wall panels may be double folded, with the outer side wall panel half laying on the outer side in contact with the exterior surface of the inner side wall panel half. The tray is maintained in shape by an enclosing envelope of transparent film material. Its assembling, filing and wrapping may be executed in one integrated process.

1 Claim, 2 Drawing Sheets

METHOD OF ASSEMBLY FOR A WRAPPER-STABILIZED PACKAGING TRAY FOLDED FROM A BLANK OF PAPER-LIKE MATERIAL AND PACKAGE TRAY

This is a continuation of application Ser. No. 07/867,128, filed on Apr. 10, 1992 abandoned.

FIELD OF THE INVENTION

The present application is in the field of packing articles. More particularly the invention relates to the packing of products, such as various kinds of bakery products, chocolate products, other foodstuffs in trays wrapped in tubular envelopes or transparent film material.

It has been known to feed a flow of individual articles through a wrapping station (commonly called "flow wrapper") wherein a web of wrapping material is supplied to form a tubular envelope which tightly encloses the flow of articles and wherein the tubular envelope is cross-sealed and cut at locations between the successive articles so as to form individual wrapped packages each container an article or stack of articles. Such a flow wrapper is known e.g. from U.S. Pat. No. 4,203,270 and European patent application 0142904 (published May 29, 1985) the contents of which are to be considered as disclosed herein by reference.

It has also been known to feed a flow of trays through a filling station where the individual trays in the flow are successively filled with the products to be packed and then feed the flow of filled trays as a flow of articles through a "flow wrapper" of the type above referred to.

Up to now most of the trays used in such packaging processes are formed of plastics material in a moulding process that is carried out quite independently of the packaging process.

Such trays which are commonly designed as disposable packages result in waste material that will decompose very slowly or even not at all. Consequently such trays are more and more considered undesirable from an environmental point of view.

It is therefore an object of the present invention to provide an alternative tray which may be easily assembled from a simple blank made of an easily decomposable material, such as paper material.

It is a further object of the present invention to provide an alternative form of tray which may be assembled in an easy manner from a simple blank as a step in an integrated tray forming, tray filing and tray wrapping process, wherein the assembled tray is maintained firmly in shape by the tubular envelope without requiring the use of an adhesive or staples, such as is the case e.g. with a well-known package according to European patent application 0249260 (published Oct. 26, 1988).

Briefly, according to one aspect of the present invention there is provided a blank for assembling a substantially rectangular packaging tray, comprising a substantially rectangular sheet of paper-like material having two longitudinal and two transversal edges, with a first fold line provided parallel to at least one of said longitudinal edges at a distance corresponding to twice the desired height of the tray to be assembled, a second fold line impressed mid-way between each first line and the adjacent longitudinal edge, a third fold line parallel to each of the transversal edges at a distance corresponding to the height of the tray, said third fold lines being cut through from the longitudinal edge(s) inwardly up to the adjacent first fold line so as to form transverse cuts, said fold lines and cuts dividing the blank into a bottom panel, an outer and an inner side wall panel at said at least one longitudinal edge, an end wall panel at each of said transversal edges and an end wall flange panel adjacent each of said cuts, the various fold lines being impressed in such a way that each inner side wall panel and each end wall panel are to fold about said first and third fold lines respectively in an upward direction relative to the plane of the blank, whereas each outer side wall panel is to fold about the respective second fold line downwardly relative to the plane of the blank.

Consequently, in the assembled state of the tray the outer side wall panels will extend downwardly from the second fold lines (forming now the open top edges of the tray) along the outwardly facing surfaces of the inner side wall panels, whereas the end wall flange panels will be captured between the inner and outer side wall panels.

The tray thus assembled is well-adapted to be kept in its assembled form by a tubular envelope that covers the open top of the tray while allowing visiual inspection of the products contained therein.

In this connection it is to be noted that German Offenlegungsschrift 2.201.641 discloses a tray blank with basically the same configuration of fold lines and cuts as with the blank according to the present application. In the well-known blank, however, the second fold lines are impressed so as to cause the outer side wall panels to be folded also upwardly relative to the plane of the blank so that in the assembled state of the tray the outer side wall panels will extend on the inwardly facing surface of the inner side wall panels. Furthermore the outer side wall panels have projecting tongues along the longitudinal edges which engage—in the assembled state—into corresponding slots in the bottom panel adjacent the first fold lines to maintain the tray assembled.

Furthermore U.S. Pat. No. 3,627,116 discloses a package for encasing containers of foodstuffs, which are folded from blanks and are kept in shape by a tubular envelope. This package, however, is an open ended box rather than a tray, whereas the blank has merely longitudinally extending fold lines, without cuts.

In accordance with another aspect of the invention there is provided a method for packing products in trays, comprising the steps of feeding a flow of trays through a filling station, where the individual trays in the flow are filled with the products to be packed, feeding the flow of filled trays through a wrapping station wherein a web of wrapping material is supplied to form a tubular envelope around the flow of trays, cross sealing and cutting the tubular envelope between the filled trays so as to form individual wrapped packages and comprising the improved initional step of assembling the trays from blanks of the type defined in accordance with said one aspect of the invention, causing the completely assembled trays to move between lateral guide means to hold the outer side wall panels in contact with the outwardly facing surface of the inner side wall panel when feeding the flow of trays through the filling and towards the wrapping station, and terminating the lateral guides at the location where the tubular envelope being formed is starting to close around the flow of trays.

DESCRIPTIVE PART OF THE SPECIFICATION

The invention will hereinafter further described by way of example with reference to the accompanying drawings in which.

Figure 1:
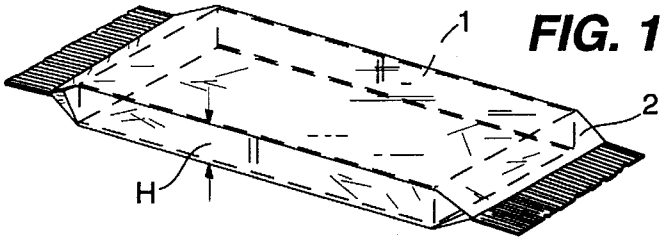
FIG. 1 is a perspective view of a packing tray according to the invention.

In FIG. 1 a packing tray is shown tightly wrapped by an envelope of film material such as cellophane.

Figure 2:
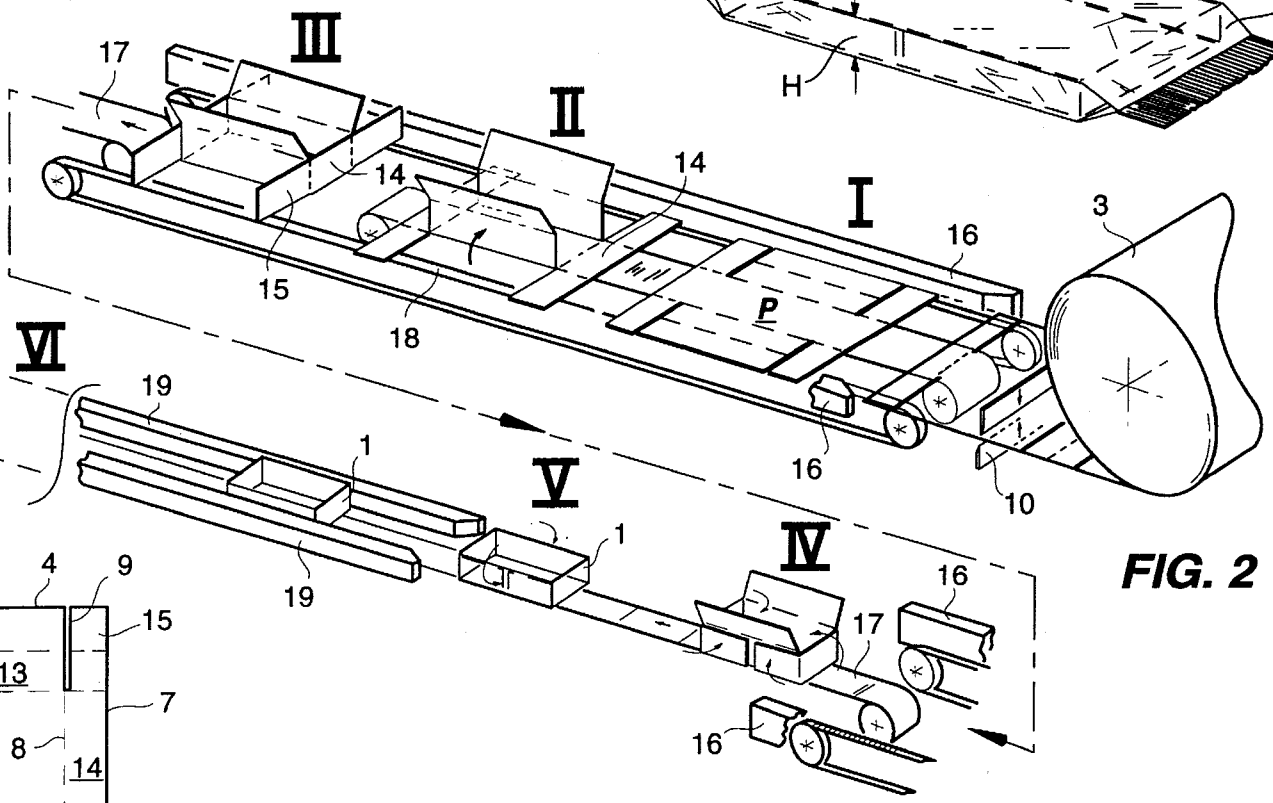
FIG. 2 is a diagrammatic and perspective view illustrating the process of cutting blanks from a supply roll and folding the latter in successive steps to a flow of packing trays according to the invention.

The packing tray 1 is folded from a substantially rectangular blank of paper material, such as the blanks P shown in FIG. 2, which are cut in succession from a supply roll 3.

Figure 3:
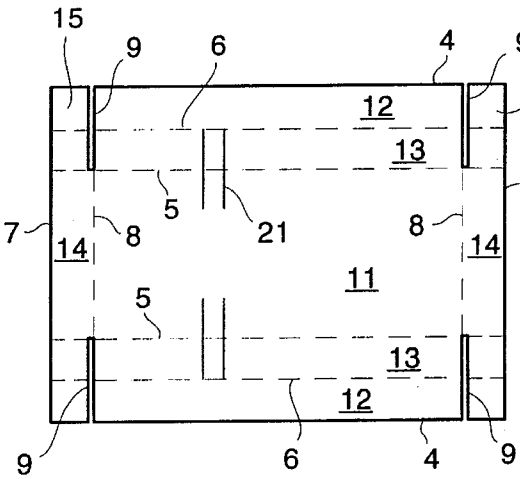
FIG. 3 is a plan view of a blank for a packing tray according to the invention.

As shown in FIG. 3, the blanks P comprise a rectangular piece of paper material, which may have a corrugated structure, with the crests and valleys directed transversely to the longitudinal direction of the blank.

A first folding line 5 is provided parallel to each of the longitudinal edges 4 of the blank P, at a distance corresponding to twice the tray height h. A second folding line 6 is impressed mid-way between each of the folding lines 5 and the respective longitudinal edges 4 of the blank.

A third folding line 8 is provided parallel to each of the short sides 7 of the blank, at a distance corresponding to the tray height h. These third folding lines 8 have been cut through from the two longitudinal edges 4 inwardly up to the first folding lines 5, so that cuts 9 are formed.

The said folding lines and cuts may be provided in the web unrolled from the supply roll by using well-known techniques. For reasons of simplicity the folding lines and cuts are shown provided in the web material while it is still on the roll.

Thus blanks P are successively severed from the supply roll 3 by means of a cutting device 10.

The folding lines 5, 6 and 8 and the cuts 9 divide the blank P into a tray bottom panel 11, two outer and inner longitudinal side wall panels 12 and 13 respectively, two end wall panels 14 and four end wall flange panels 15.

In the diagrammatic view of FIG. 2 the starting material supplied from the supply roll 3 and to be cut into individual blanks is put onto a conveyor line between two lateral guides 16. In the example shown the conveyor line is formed by a central conveyor belt 17, with an additional belt 18 provided on either side of the latter.

In a first station indicated at I the blank is still in a completely flat state. In a second station II the folding of the longitudinal side wall panels 12, 13 is effected by folding about the first or inner fold lines 5 (see the arrow direction). From station II the partly folded tray is transferred—with the (still flat lying) end wall panels 15 supported on the two pusher belts 8, to a third station III. There is an interruption of the central conveyor belt 17 in the third station, which allows the folding of the end wall panels by folding about the third fold lines 8 (see the arrows in the third station III).

From the station III the tray is—now with the end wall flanges 15 supporting in a vertical position on the lateral conveyor belts 18—transferred onto the continuing central conveyor belt 17 in a fourth station IV. Within the station IV the end wall flanges 15 are folded inwardly (see the arrow direction) against the outer side of the vertically extending inner longitudinal side wall panels 13, after which the tray is displaced into a fifth station V. In the station V the tray 1 is completed by folding the outer longitudinal side wall panels 12 downwardly. The tray is then—in its completed state-passed on and caught between lateral guide means 19 which keep the outer longitudinal side wall panels 12 in the outwardly and downwardly folded positions. In this state the tray is passed through a filling station (VI shown schematically in FIG. 2), where the tray may be filled. In continuation thereof the tray—while still being kept in shape between the continuing guide means 19—is passed through the so-called "flow-packer" which is shown schematically in FIG. 2 and defines a wrapping station VII, which provides the filled tray with a tight wrapper of cellophane. The lateral guide means 19 are discontinued at a location where the leading end of the tray is engaged by the wrapping tube being formed.

Figure 4:
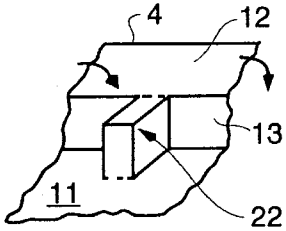
FIG. 3A is a plan view of a modified blank for a package tray according to the invention and FIG. 4 is a perspective view of a detail of a partially folded packing tray.

The blank P shown in FIG. 3 is also provided with two pair of additional cuts 21, which extend from the second fold lines 6 inwardly to an extent corresponding with twice the tray height. When folding the longitudinal side wall panels 12, 13 upwardly, these additional cuts allow the forming of portions 22 (see FIG. 4) which extend inwardly from the inner longitudinal side wall panels and may function as a partition to divide the tray into compartments.

It will be appreciated that the scope of the invention is not limited to the blank shown in FIG. 3.

Figure 3A:
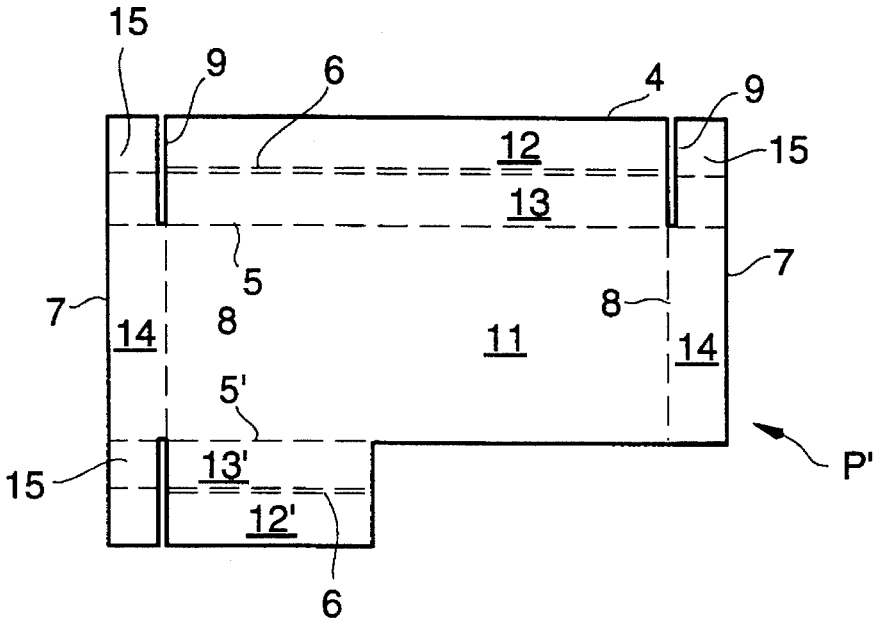

As an example, starting from the blank shown in FIG. 3, it would be possible to cut-away at least a part of the length of the panels forming together one of the longitudinal side walls of the tray. In such a case e.g. at least one of the end wall flange panels 15 and at least a part of the length of the adjoining side wall panels 13 and 12 positioned e.g. below the lower fold line 5 in FIG. 3 could be cut-away. This would result e.g. in a modified blank P' as shown in FIG. 3A. In such a tray the packed articles would be displayed in an attractive manner.

I claim:

1. A method for packaging products in a continuous flow comprising the steps of providing a supply of tray blanks comprising a substantially rectangular sheet which is made of a corrugated paper material, which is initially situated in a generally horizontal plane and which has two spaced apart longitudinal edges and two spaced apart transversely extending edges, with a first fold line provided parallel to at least one of said longitudinal edges at a distance corresponding to twice the height of each tray to be assembled and filled by the method, a second fold line impressed midway between each first fold line and the adjacent one of said longitudinal edges, a third fold line situated adjacent to and parallel to each one of the transversely extending edges at a distance corresponding to the distance between one of said longitudinal edges and the adjacent second fold line which is equal to the height of the tray to be formed, each third fold line being cut in said blank inwardly from one of the longitudinal edges through said second fold line to the first fold line inwardly adjacent to that one longitudinal edge so as to form transverse cuts, said fold lines and cuts dividing the blank into a bottom panel, an outer side wall panel and an inner side wall panel at said at least one longitudinal edge, an end wall panel at each of said transversely extending edges and an end wall flange panel adjacent each of said cuts;

placing the blanks for movement past work stations with the inner and outer side wall panels each having a longitudinal axis thereof positioned to extend in a direction that is parallel to, or collinear with, said first fold line and the direction of movement of said blanks;

folding the inner side wall panels and the end wall panels about said first and third fold lines respectively in an upward direction relative to the plane of the blank;

folding the downstream end flange panel backwardly and folding the upstream end flange panel forwardly each to lie against an outwardly facing surface of one of said inner side wall panels that have been folded upwardly from one of said first fold lines;

folding the outer side wall panels about the respective second fold lines downwardly and outwardly relative to the plane of the blank along the outwardly facing surfaces of the respective inner side wall panels to capture said end wall flange panels between said inner and outer side wall panels;

moving each tray, created by the folding of the panels in the manner described above, in a flow direction between lateral guide means to hold the outer side wall panels in contact with the outwardly facing surface of the inner side wall panels;

feeding the moving trays, while guided between the guide means, through a filling station, where each tray in the flow direction is filled with a product to be packaged;

feeding the filled trays through a wrapping station wherein a web of wrapping material is supplied to form a tubular envelope around the filled trays;

terminating the lateral guide means within the wrapping station where the tubular envelope being formed is closed around the flow of trays; and, cross-sealing and cutting the tubular envelopes between the filled trays so as to form individual wrapped packages.

* * * * *